US010398928B2

(12) United States Patent
Perez Gomez

(10) Patent No.: US 10,398,928 B2
(45) Date of Patent: Sep. 3, 2019

(54) BODYWEIGHT EXERCISE APPARATUS

(71) Applicant: Jose Miguel Perez Gomez, Caracas (VE)

(72) Inventor: Jose Miguel Perez Gomez, Caracas (VE)

( * ) Notice: Subject to any disclaimer, the term of this patent is extended or adjusted under 35 U.S.C. 154(b) by 178 days.

(21) Appl. No.: 15/126,044

(22) PCT Filed: May 20, 2016

(86) PCT No.: PCT/IB2016/000914
§ 371 (c)(1),
(2) Date: Jun. 20, 2017

(87) PCT Pub. No.: WO2016/185288
PCT Pub. Date: Nov. 24, 2016

(65) Prior Publication Data

US 2017/0312564 A1 Nov. 2, 2017

Related U.S. Application Data

(60) Provisional application No. 62/164,232, filed on May 20, 2015.

(51) Int. Cl.
*A63B 21/068* (2006.01)
*A63B 21/00* (2006.01)
(Continued)

(52) U.S. Cl.
CPC ..... *A63B 21/068* (2013.01); *A63B 1/00* (2013.01); *A63B 21/00047* (2013.01);
(Continued)

(58) Field of Classification Search
CPC ..... A63B 1/00; A63B 21/00047; A63B 21/0552; A63B 21/068; A63B 21/169;
(Continued)

(56) References Cited

U.S. PATENT DOCUMENTS 4,456,246 A * 6/1984 Szabo ..... A63B 21/06 482/98
5,018,725 A * 5/1991 Cook ..... A63B 21/154 482/103
(Continued)

OTHER PUBLICATIONS

Balazs Adjustable Wall-Mounted Pullup Bars, http://www.balazsboxing.com/cgi-bin/catalog2.cgi?action=page&page=MO0210. US.
(Continued)

*Primary Examiner* — Joshua Lee
(74) *Attorney, Agent, or Firm* — The Belles Group, P.C.

(57) ABSTRACT

An exercise apparatus includes: a support track including a first channel on a first side, a second channel on a second side, and a row of fixation holes, the first channel, the second channel, and the row of fixation holes being parallel to each other; a carriage including a carriage frame, a pin rod, a first side roller, and a second side roller, wherein: the pin rod is coupled to the carriage frame and positioned to be removably inserted into at least one of the fixation holes to fix a position of the carriage with respect to the support track, the first side roller is coupled to the carriage frame and positioned within the first channel, and the second side roller is coupled to the carriage frame and positioned within the second channel; and at least one support bar affixed to the carriage.

20 Claims, 18 Drawing Sheets

(51) Int. Cl.

| | |
|---|---|
| ***A63B 21/16*** | (2006.01) |
| ***A63B 71/00*** | (2006.01) |
| ***A63B 1/00*** | (2006.01) |
| ***A63B 21/055*** | (2006.01) |
| ***A63B 23/12*** | (2006.01) |

(52) U.S. Cl.
CPC ..... *A63B 21/0552* (2013.01); *A63B 21/169* (2015.10); *A63B 21/4035* (2015.10); *A63B 21/4045* (2015.10); *A63B 23/1218* (2013.01); *A63B 71/0009* (2013.01); *A63B 2071/0018* (2013.01); *A63B 2208/029* (2013.01); *A63B 2209/02* (2013.01); *A63B 2225/093* (2013.01)

(58) Field of Classification Search
CPC ..... A63B 21/4035; A63B 23/1218; A63B 71/0009; A63B 2071/0018; A63B 2208/029; A63B 2209/02; A63B 2225/093
See application file for complete search history.

(56) References Cited

U.S. PATENT DOCUMENTS 5,195,937 A * 3/1993 Engel ..... A63B 21/015 482/116
5,688,216 A * 11/1997 Mauriello ..... A63B 21/154 482/101
5,971,897 A * 10/1999 Olson ..... A63B 21/0626 482/101
7,172,538 B2 * 2/2007 Keiser ..... A63B 21/0087 482/140
7,335,141 B2 * 2/2008 Piane, Jr. ..... A63B 21/055 482/101
D578,582 S 10/2008 Gomez
8,172,733 B1 * 5/2012 Batca ..... A63B 21/156 482/93
8,246,524 B2 * 8/2012 Castillo ..... A63B 21/023 482/101
8,834,328 B1 * 9/2014 Batca ..... A63B 21/00043 482/100
2005/0049115 A1 3/2005 Gomez
2007/0161472 A1 * 7/2007 Drechsler ..... A63B 15/00 482/100
2014/0121071 A1 * 5/2014 Strom ..... A63B 21/062 482/99

OTHER PUBLICATIONS

Suples Training Systems, Gladiator Wall, http://suples.com/gladiator-wall/. US.

* cited by examiner

BODYWEIGHT EXERCISE APPARATUS

CROSS REFERENCE TO RELATED APPLICATIONS

The present application is a U.S. national stage application under 35 U.S.C. § 371 of PCT Application No. PCT/IB2016/000914, filed May 20, 2016, which claims priority to U.S. Provisional Application No. 62/164,232, filed May 20, 2015, the entireties of which are incorporated herein by reference.

FIELD OF THE INVENTION

The field of the present invention relates to exercise equipment, and particularly to an exercise apparatus which enables a variety of different exercises to be performed, the exercises using an individual's body weight for strength training.

BACKGROUND OF THE INVENTION

The preference to exercise in indoor spaces has experienced a strong rise during the last 20 years, and thus there is an increasing number of manufacturers offering exercise apparatuses that make it possible to practice different types of exercises. Apparatuses are available which facilitate cardiovascular or aerobic activities, such as treadmills, steppers, or elliptical machines. Certain apparatuses also facilitate anaerobic activities, such as those practiced using weights or other mechanisms that use counterweights and pulleys.

However, many of the apparatuses currently available on the market are more expensive than many individuals are able to afford. In addition, many of the apparatuses enable only one or two types of exercises, such that multiple different types of apparatuses are required for an individual to perform a broader range of exercises. In addition, certain types of apparatuses require the separate addition of various weights to complete the equipment, and certain apparatuses may require substantial space. Recent attempts have been aimed at simplifying exercise apparatuses, both with respect to the amount of space they occupy and to maximize the types of exercises the apparatus facilitates.

The use of an individual's own body weight as part of an exercise eliminates the need for separate weights as part of the apparatus. Thus, apparatuses that bodyweight to for purposes of strength training, particularly for the upper torso, have become more popular. Not only do such bodyweight apparatuses typically require less space, but also the lack of the need for weights adds to the overall simplicity of an apparatus, so that less space is required and a lower cost can be achieved. Most bodyweight apparatuses on the market, however, primarily are free standing or require a door frame. An example of a free standing bodyweight exercise apparatus is disclosed in U.S. Design Pat. No. D578,582. The free standing apparatuses still require space with is not insubstantial, and the door frame apparatuses generally facilitate only a single exercise type, such as a pull-up.

In view of the shortcomings of bodyweight exercise apparatuses available on the market, a need exists for a bodyweight exercise apparatus that occupies less space than known free standing apparatuses while at the same time facilitates a greater variety of exercises.

SUMMARY OF THE INVENTION

The present invention is directed toward a bodyweight exercise apparatus which facilitates a variety of exercises using an individual's own body weight, with the types of exercises facilitated extending beyond just pull-up type exercises. The exercise includes a support track which is wall mountable, a carriage which may be position adjusted with respect to the support track, and a support bar.

In a first separate aspect of the present invention, an exercise apparatus includes: a support track having a first side opposite a second side and including a first channel extending parallel to a first shoulder on the first side and a second channel extending parallel to a second shoulder on the second side, the first channel and the second channel each including a plurality of fixation holes; a carriage including a carriage frame, a pin rod, and a plurality of first side rollers opposing a plurality of second side rollers, wherein: the pin rod is coupled to the carriage frame and positioned to be removably inserted into one of the fixation holes in the first channel and into one of the fixation holes in the second channel to fix a position of the carriage with respect to the support track, at least one of the first side rollers is coupled to the carriage frame and positioned within the first channel and another of the first side rollers is coupled to the carriage frame and positioned against the first shoulder, and at least one of the second side rollers is coupled to the carriage frame and positioned within the second channel and another of the second side rollers is coupled to the carriage frame and positioned against the second shoulder; and at least one support bar coupled to the carriage.

In a second separate aspect of the present invention, an exercise apparatus includes: a support track having a first track side opposite a second track side, each track side including a first shoulder opposing a second shoulder and a plurality of fixation holes aligned in a row adjacent and parallel to the first shoulder; a carriage including a carriage frame, a pin rod, and a plurality of first side rollers opposing a plurality of second side rollers, wherein: the pin rod is coupled to the carriage frame and positioned to be removably inserted into one of the fixation holes on the first track side and into one of the fixation holes on the second track side to fix a position of the carriage with respect to the support track, at least one of the first side rollers is coupled to the carriage frame and positioned to roll against the first shoulder of the first track side and another of the first side rollers is coupled to the carriage frame and positioned to roll against the second shoulder of the first track side, and at least one of the second side rollers is coupled to the carriage frame and positioned to roll against the first shoulder of the second track side and another of the second side rollers is coupled to the carriage frame and positioned to roll against the second shoulder of the second track side; and at least one support bar coupled to the carriage.

In a third separate aspect of the present invention, an exercise apparatus includes: a support track having a first side opposite a second side and including a first channel on the first side, a second channel on the second side, and a row of fixation holes, the first channel, the second channel, and the row of fixation holes being parallel to each other; a carriage including a carriage frame, a pin rod, at least one first side roller, at least one second side roller, at least one first bearing rod, and at least one second bearing rod, wherein: the pin rod is coupled to the carriage frame and positioned to be removably inserted into at least one of the fixation holes to fix a position of the carriage with respect to the support track, at least one of the first side rollers is coupled to the carriage frame and positioned within the first channel, at least one of the second side rollers is coupled to the carriage frame and positioned within the second channel, the at least one first bearing rod is affixed to the carriage frame and positioned within the first channel to bear against a first channel wall of the first channel, and the at least one second bearing rod is affixed to the carriage frame and positioned within the second channel to bear against a second channel wall of the second channel; and at least one support bar affixed to the carriage.

Accordingly, an improved bodyweight exercise apparatus is disclosed. Advantages of the improvements will be apparent from the drawings and the description herein.

BRIEF DESCRIPTION OF THE DRAWINGS

The foregoing summary, as well as the following detailed description of the exemplary embodiments, will be better understood when read in conjunction with the appended drawings. It should be understood, however, that the invention is not limited to the precise arrangements and instrumentalities shown in the following figures.

DETAILED DESCRIPTION OF THE INVENTION

Figure 1:
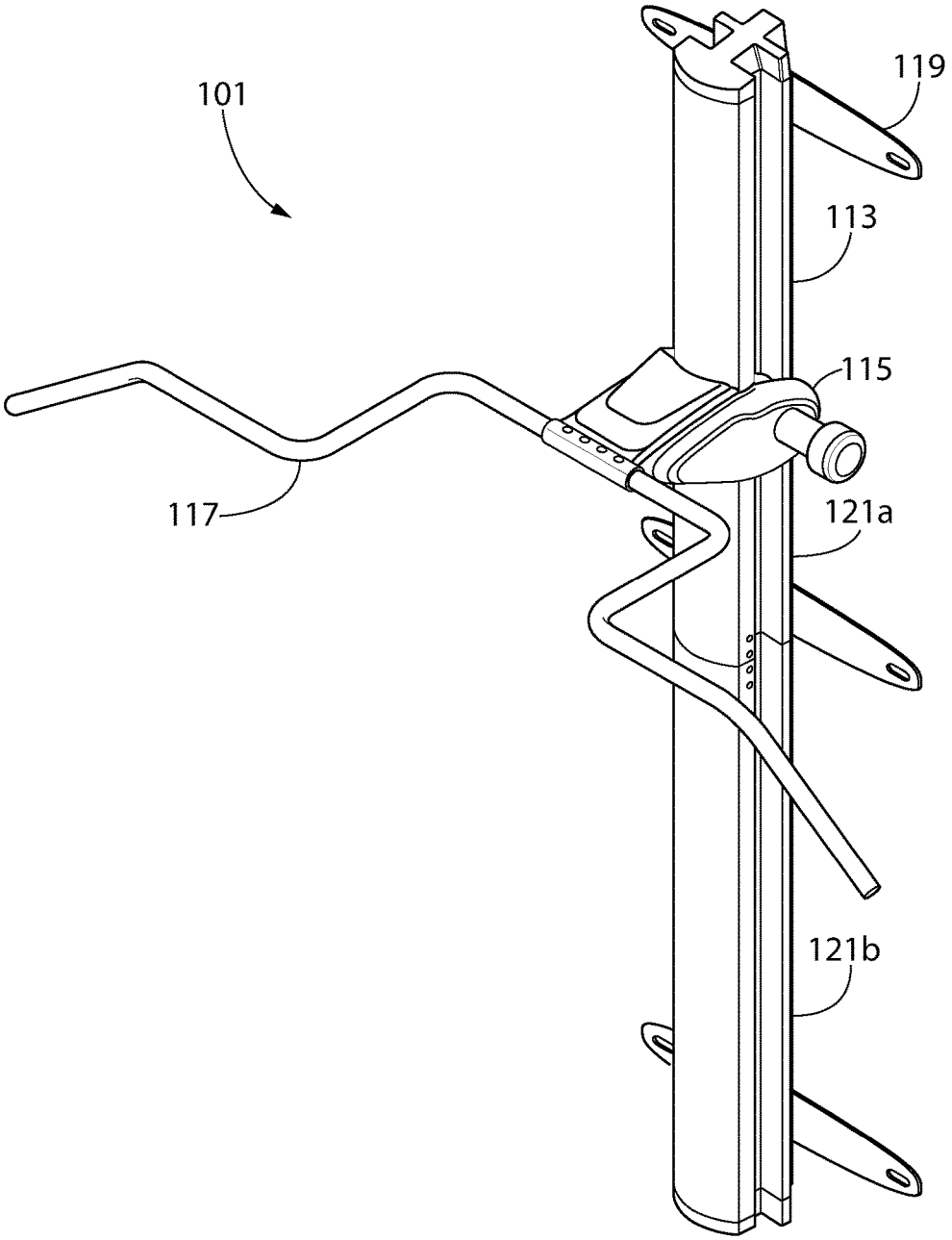
FIG. 1 is a perspective view of a bodyweight exercise apparatus.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combinations of features that may exist alone or in other combinations of features; the scope of the invention being defined by the claims appended hereto.

As will be apparent from the following description, the disclosed bodyweight exercise apparatus facilitates a variety of exercises that use the bodyweight of the individual to provide strength and resistance training. The exemplified of the exercise apparatus may be installed in an indoor space on any vertical surface, such as a wall formed by drywall, wood, concrete and the like. The invention, however, is not to be so limited, as the exercise apparatus may be installed outside and on any support structure which may be adapted to provide a stable vertical orientation for the exercise apparatus.

When used indoors, the space in which the exercise apparatus is installed may be limited or ample, and it may be a closed space or open to the outdoors. For certain embodiments, the space may preferably be a roofed space for the purpose of avoiding exposing the exercise apparatus, and the material from which the various parts are made, to the weather.

In the exemplified embodiment, the exercise apparatus is constructed primarily from aluminum and mild steel. However, the exercise apparatus may be also constructed from a variety of other materials, such as stainless steel or carbon fiber. In addition, some of the pieces of the exercise apparatus may be manufactured through extrusion and/or molding processes, and such pieces may be extruded, as appropriate, from materials such as aluminum or plastic. Certain pieces of the exercise apparatus may be formed from molded plastic.

It should be recognized that the disclosed exercise apparatus is suited for all users, including low height people, and has also been designed so that users with a disability in the lower limbs may also use the apparatus. Similarly, the exercise apparatus may be used by people of all ages and genders, including people with different fitness skills, such as limited strength, endurance, balance or coordination, or disabilities such as limited vision, wheelchair users or even people in muscular or joint rehab exercise programs.

In the description below, certain structures of the exercise apparatus are described as being coupled by welding, and such welding may be of the special aluminum welding wire type, which contains 5% of silicon aluminum filler. In addition, the term running weld refers to known welding techniques in which a continuous weld is used to make the apparatus as a whole robust and to prevent the apparatus from twisting during use.

Turning in detail to the drawings, FIG. 1 illustrates an exemplified embodiment of the bodyweight exercise apparatus 101. The exercise apparatus 101 chiefly includes a support track 113, a carriage 115, and a support bar 117. The support track 113 may be affixed to a vertical surface (not shown) using wall mount brackets 119. Generally, the carriage 115 is moveable vertically along the support track 113, and the carriage 115 may be set in a fixed position on the support track 113 by engaging a pin rod, included as part of the carriage 115, with holes included as part of the support track 113.

In the embodiment shown, the support track 113 is formed by two track sections 121*a*, 121*b*. In other embodiments, the support track 113 may be a single piece, or it may include more than two pieces. In certain embodiments, the length of the track is such that it can extend from near a floor to near a ceiling, or approximately 6 feet in length, so that a full range of exercises is facilitated. In still other certain embodiments, the ends of the support track 113 may include plastic caps to improve the appearance thereof.

The two track sections 121*a*, 121*b* are identical to allow the carriage 115 to travel at least substantially the entire length of the support track 113. One of the track sections 121*a* is shown in FIGS. 2A-D. As can be seen from in FIGS. 2A-B, the track section 121*a* extends along a longitudinal axis LA and is symmetrical about a lateral plane LA. The track section 121*a* includes a front side 123, a back side 125, a first track side 127*a* and a second track side 127*b*. The first and second track sides 127*a*, 127*b* are formed as mirror images of each other.

Each track side 127*a*, 127*b* includes a channel 131, and as shown the channels 131 extend the entire length of the track section 121*a*, although the invention is not to be so limited. In certain embodiments, the channels 131 may extend less than the entire length of the track section 121*a*. Each channel includes a channel floor 133 and two channel walls 135, 137. As will become apparent from the ensuing description, one or both of the channel walls 135, 137 may serve as a shoulder for purposes of moving the carriage and load bearing during exercises. The channel wall 135 forms part of a rib 139 which runs alongside and parallel to the channel 131. The side of the rib 139 opposite the channel wall 135 forms a shoulder 141, and both the channel 131 and the shoulder 141 are used in the exemplified embodiment to enable movement and provide support to the carriage 115.

Figure 2A:
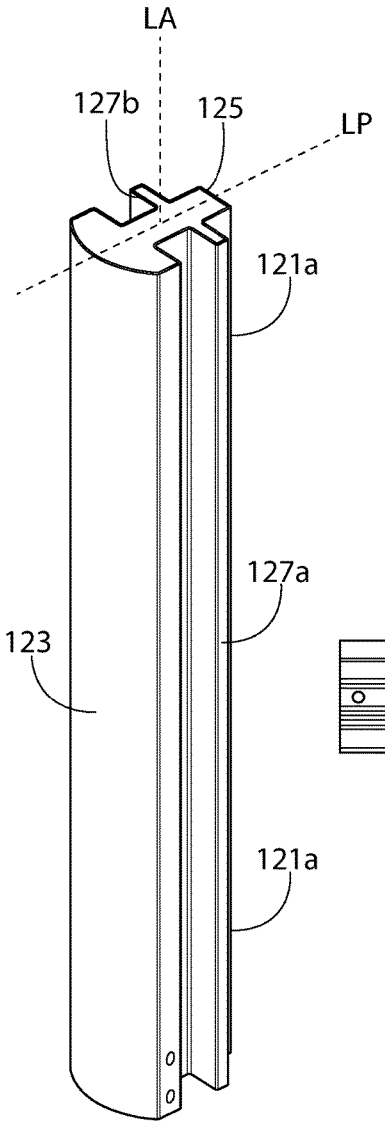
FIGS. 2A-D illustrate the support track of the exercise apparatus of FIG. 1.
Figure 2B:
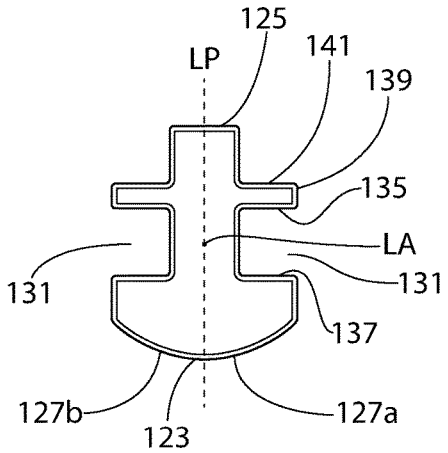
Figure 2C:
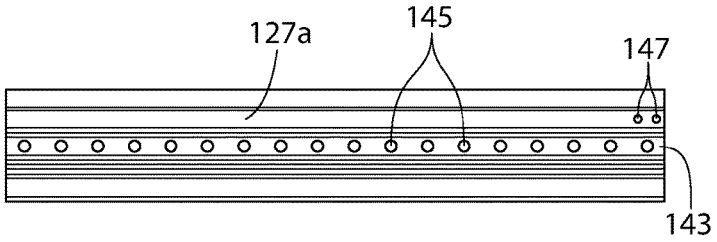

One of the track sides 127*a* is shown in FIG. 2C, which is also intended to be representative of the other track side 127*b*. In certain embodiments, the two track sides may not be mirror images of one another. As shown, a row 143 of fixation holes 145 (holes) are formed in the channel floor 133. The row of fixation holes 143 extends along the channel floor 133, and thus is parallel to the channel 131 itself. The purpose of the fixation holes will become apparent from the description below. In certain embodiments, the row 143 of fixation holes 145 may be formed in a position other than the channel floor 133. However, in such embodiments, the row 143 of fixation holes 145 still extends parallel to the channel 131. Moreover, in certain embodiments, the track section 121*a* may include only one row 143 of fixation holes 145, as opposed to two rows as shown, each associated with one of the track sides 127*a*, 127*b*. In certain embodiments, adjacent fixation holes 145 may be set apart from one another by about 2". In other embodiments, the distance between adjacent holes may be greater or smaller than this distance.

Figure 4A:
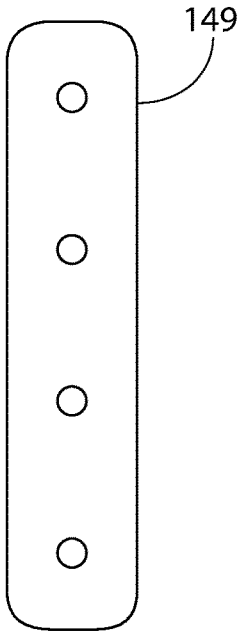
FIGS. 4A-B illustrate a coupling plate of the exercise apparatus of FIG. 1.
Figure 4B:
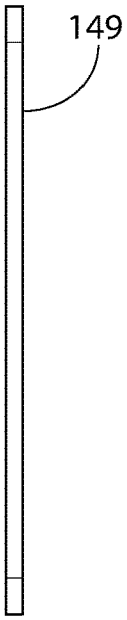

The track side 127*a* of the track section 121*a* also includes coupling holes 147 which are used to couple one track section 121*a* to the other track section 121*b* using the coupling plate 149 shown in FIGS. 4A-B. The coupling plate 149 extends between and is coupled to both track sections 121*a*, 121*b* by a fastener, such as a screw or the like.

Figure 2D:
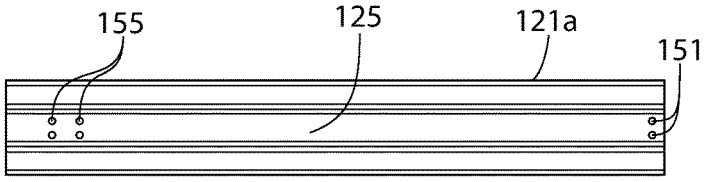
Figure 5A:
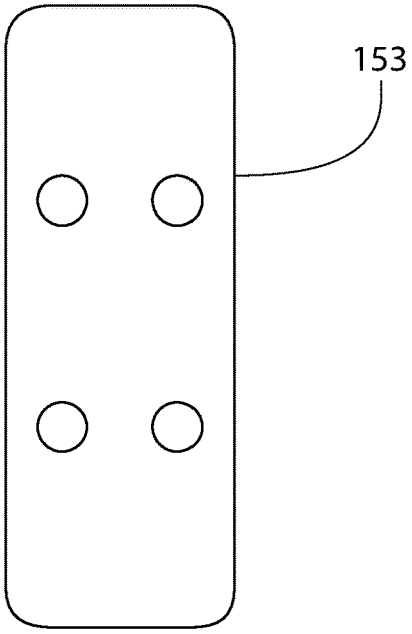
FIG. 5A-B illustrate a back coupling plate of the exercise apparatus of FIG. 1.
Figure 5B:
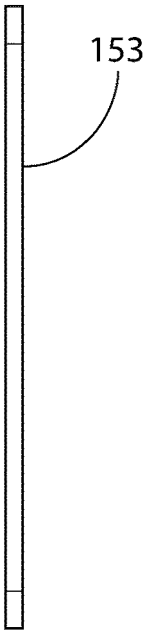

The back side 125 of the support track 113 is shown in FIG. 2D. The back side 125 includes coupling holes 151 which are also used to couple one track section 121*a* to the other track section 121*b* using the back coupling plate 153 shown in FIGS. 5A-B. the back coupling plate 153 extends between and is coupled to both track sections 121*a*, 121*b* by a fastener, such as a screw or the like. The coupling holes 151 are spaced such that a wall mount bracket 119 may be coupled at this location to both track sections 121*a*, 121*b*.

Figure 3A:
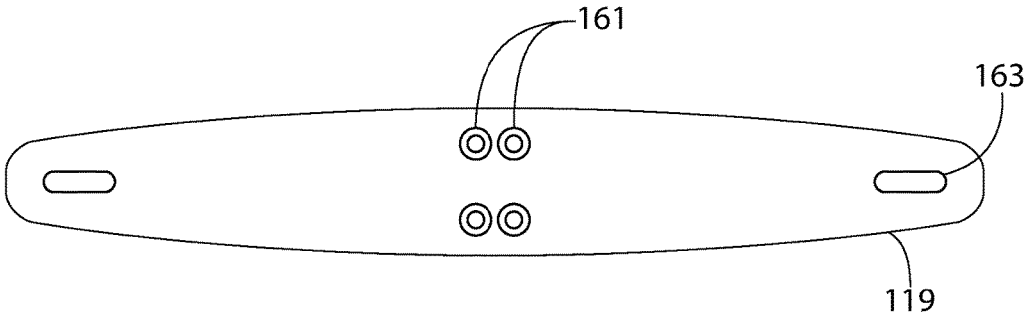
FIGS. 3A and 3B illustrate front and back views, respectively, of the wall-mount bracket of the exercise apparatus of FIG. 1.
Figure 3B:
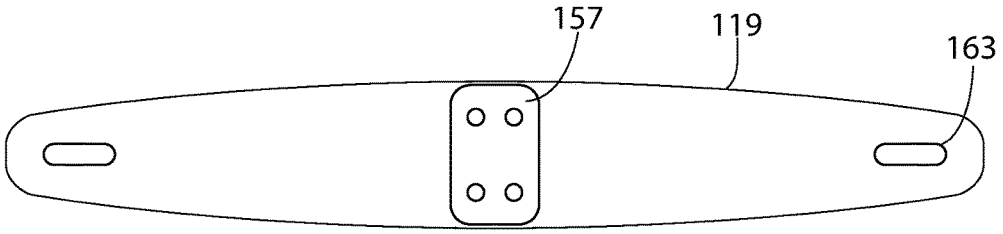
Figure 6A:
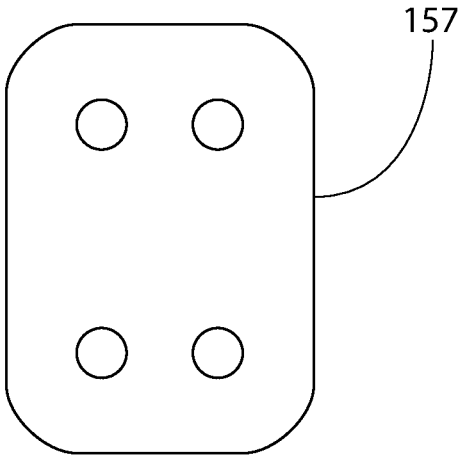
FIG. 6A-B illustrate a bracket plate of the exercise apparatus of FIG. 1.
Figure 6B:
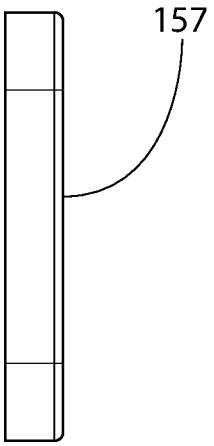

The back side 125 also includes holes 155 which are used to affix the bracket plate 157 shown in FIGS. 6A-B. The bracket plate 157 is coupled between the back side 125 of the support track 113 and the wall mount brackets 119, as shown in FIG. 3B. The wall mount brackets 119 include holes 161 for coupling to the bracket plate 157 and to the back side 125 of the support track 113. As shown in FIGS. 3A-B, the wall mount brackets 119 also includes holes 163 which are used to couple the bracket plate to a wall or other support structure. In the embodiment shown, the holes 163 are spaced apart at a distance to accommodate the standard distance between studs which support drywall in homes within the U.S., making it possible to achieve an adequate, firm and resistant anchorage for the exercise apparatus 101, capable of withstanding loads of up to 600 lbs. The holes 163, therefore, may be spaced at any appropriate distance needed for securely mounting the support track 113 to a wall. In certain embodiments, the wall mount brackets 119 may have an entirely different form, such as is appropriate for coupling the support track 113 to any non-planar support structure.

Figure 7:
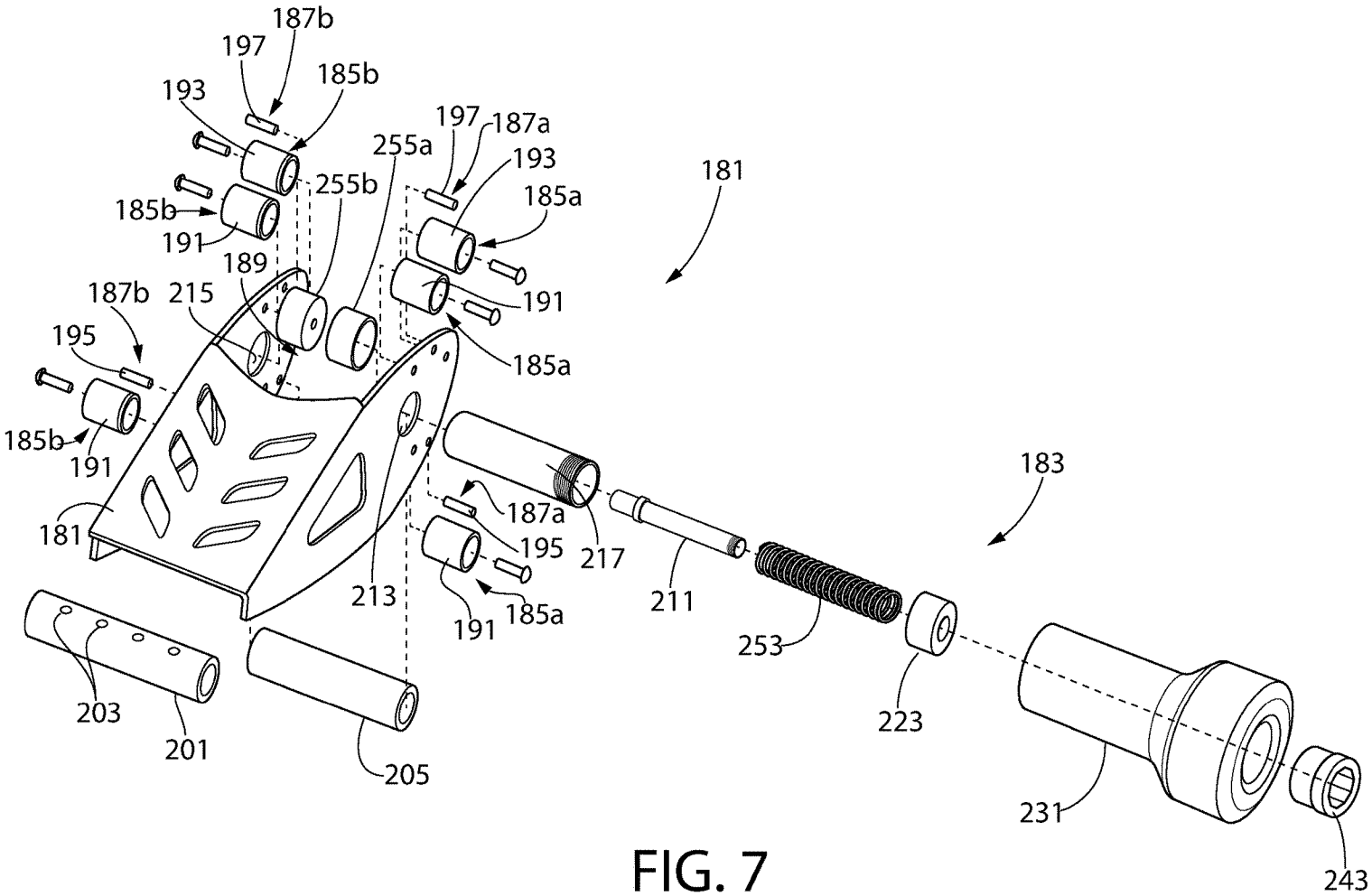
FIG. 7 is an exploded view of the carriage of the exercise apparatus of FIG. 1.

The carriage 115 for the exercise apparatus 101 is shown in exploded view in FIG. 7. The carriage 115 includes a carriage frame 181, a blocking mechanism 183, and a plurality of rollers 185*a*, 185*b*, and a plurality of bearing rods 187*a*, 187*b*. The geometry of the carriage frame 181 is such that central opening 189 is formed for receiving the support track 113 and so that the carriage 115 may move up and down the support track 113. In certain embodiments, the carriage body 181 may be aesthetically covered with plastic pieces which confer an attractive look.

The rollers 185*a*, 185*b* are coupled to the carriage frame 181 by fasteners which pass through the entire length of each respective roller 185*a*, 185*b* so that the rollers 185*a*, 185*b* are able to rotate as the carriage 115 is moved with respect to the support track 113. The rollers are positioned so that they may engage the support track 113 when the carriage 115 is moved up or down the support track 113. The rollers 185*a*, 185*b* are not only provided to enable the carriage 115 to move with respect to the support track 113, they also provide additional support to the carriage 115 against bearing surfaces of the support track 113 during exercises. In certain embodiments, the rollers 185*a*, 185*b* may be made out of polyurethane. However, in other embodiments, the rollers 185*a*, 185*b* may be made from a different material, such as other plastics, rubber, and the like. For certain embodiments, the rollers 185*a*, 185*b* may be made of a material which provides high friction when rolling against the support track 113.

Particularly, the carriage 115 includes first side rollers 185*a* positioned on one side of the carriage frame 181 opposing second side rollers 185*b*. The first side rollers 185*a* are positioned to engage one track side of the support track 113, and the second side rollers 185*b* are positioned to engage the other track side of the support track 113. Each of the first and second side rollers 185*a*, 185*b* includes one or more rollers 191 which engage the respective channel 131 on one of the sides of the support track 113. Each of the first and second side rollers 185*a*, 185*b* also includes at least one roller 193 which engages the respective shoulder 141 on one of the sides of the support track 113. The rollers 185*a*, 185*b* engage respective surfaces of the support track 113 when the carriage 115 is moved up or down the support track 113.

The bearing rods 187*a*, 187*b* are affixed to the carriage frame 181 in positions so that they may bear against the support track 113 when the carriage 115 is in a fixed position on the support track 113 and a load is placed on the carriage 115 by exercise. Particularly, the carriage 115 includes first side bearing rods 187*a* positioned on one side of the carriage frame 181 opposing second side bearing rods 187*b*. The first side bearing rods 187*a* are positioned to bear against one track side of the support track 113, and the second side bearing rods 187*b* are positioned to bear against the other track side of the support track 113. Each of the first and second side bearing rods 187*a*, 187*b* includes at least one bearing rod 195 positioned to bear against the channel wall 135 of the respective channel 131 on one of the sides of the support track 113 when a load is placed on the carriage 115. Each of the first and second side bearing rods 187*a*, 187*b* also includes at least one bearing rod 197 positioned to bear against the respective shoulder 141 on one of the sides of the support track 113 when a load is placed on the carriage 115.

In certain embodiments, the bearing rods 187*a*, 187*b* are formed from alloy steel and covered with a nylon sleeve. In certain embodiments, the bearing rods 187*a*, 187*b* are welded to the carriage frame 181 to provide the desired structural strength, as the bearing rods 187*a*, 187*b* are intended to simultaneously act as a stop and support, in order to counteract the forward driving force of the main bar when exercising, so that this force does not act directly on the rollers.

Figure 12:
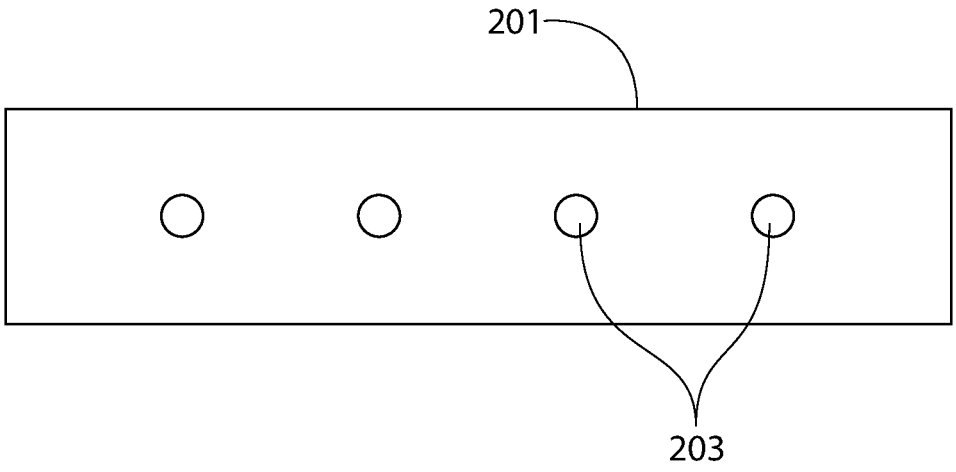
FIG. 12 illustrates the bar coupler for the carriage of FIG. 10.
Figure 13:
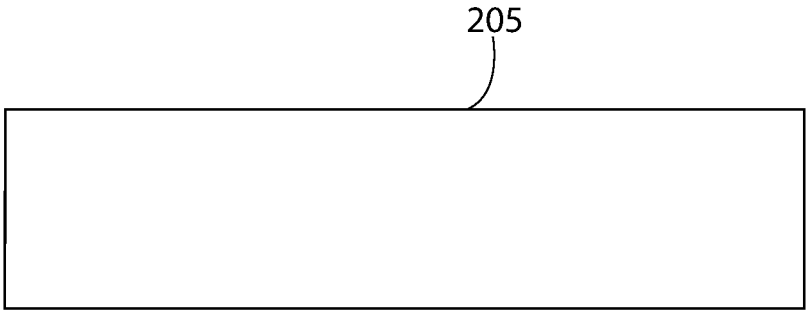
FIG. 13 illustrates the accessory bar for the carriage of FIG. 10.

The carriage 115 includes a bar coupler 201 affixed to the front of the carriage frame 181. The bar coupler 201 is provided to couple the support bar 117 to the carriage 115. The bar coupler 201 (also shown in FIG. 12) includes a plurality of holes 203 which enable the support bar 117 to the carriage 115 using an appropriate fastener, such as a bolt or screw.

Figure 8:
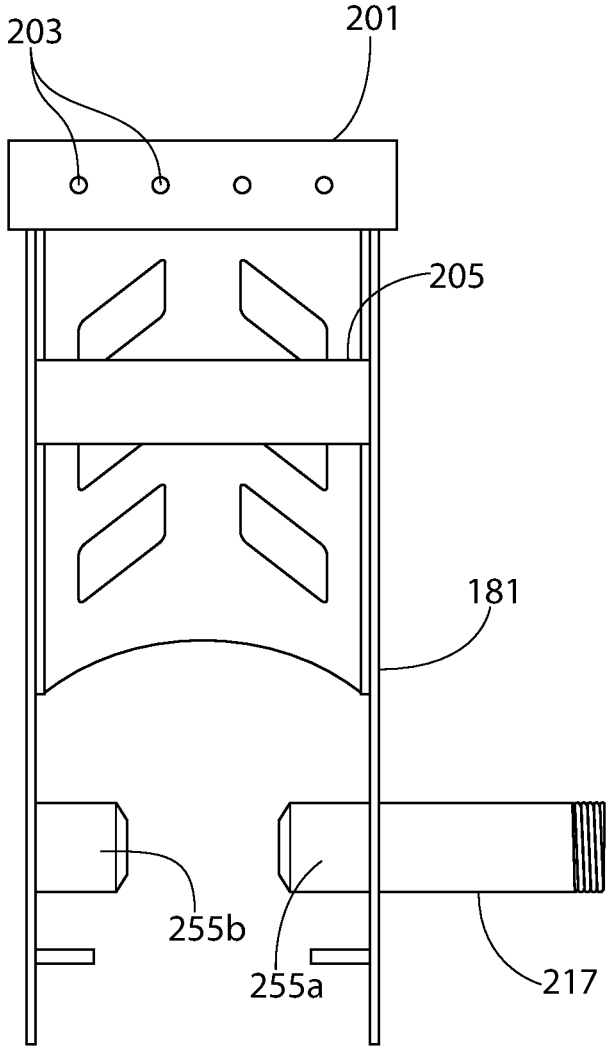
FIG. 8 is a bottom elevation view of the bracket forming part of the carriage of FIG. 7.

The carriage 115 also includes an accessory bar 205 affixed to sidewalls of the carriage frame 181, as can be seen in FIG. 8. In certain embodiments, the accessory bar 205 is affixed to the carriage frame 181 by continuous welding. In certain embodiments, the accessory bar 205 is a cylindrical tube which is provided for the attachment of exercise bands, both elastic and fixed, which may be employed for different types of exercises. The form of the accessory bar may be varied, such that other types of exercise accessories may be coupled thereto.

The blocking mechanism 183 serves to fix the carriage 115 in a selected position with respect to the support track 113. The blocking mechanism 183 can be seen in FIG. 7, with the component parts shown in FIGS. 14-19, such that the following description of the blocking mechanism 183 may refer to combinations of these figures. To this end, the blocking mechanism 183 includes a pin rod 211 which is inserted through the fixation holes 145 of the support track 113 to set the position of the carriage 115. In order to help maintain the position of the carriage 115 with respect to the support track 113, the pin rod 211 is spring biased toward insertion into the fixation holes 145. In this way, the pin rod 211 stays inserted into the selected fixation holes 145 (or in certain embodiments, into a selected single fixation hole).

Figure 14:
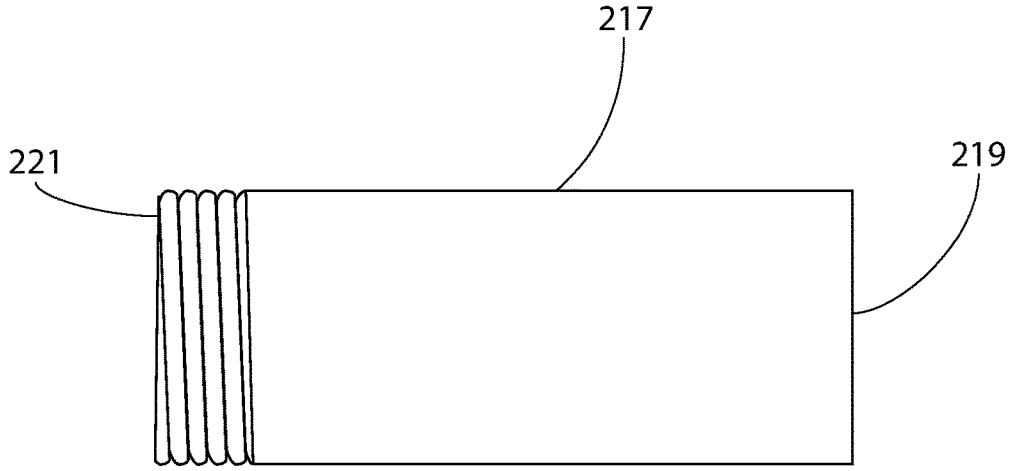
FIG. 14 illustrates the pin stud for the carriage of FIG. 10.
Figure 15:
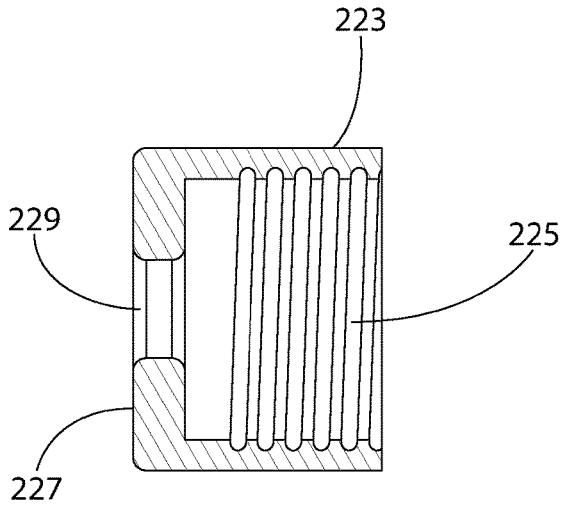
FIG. 15 illustrates a sectional view of the end cap for the carriage of FIG. 10.
Figure 16:
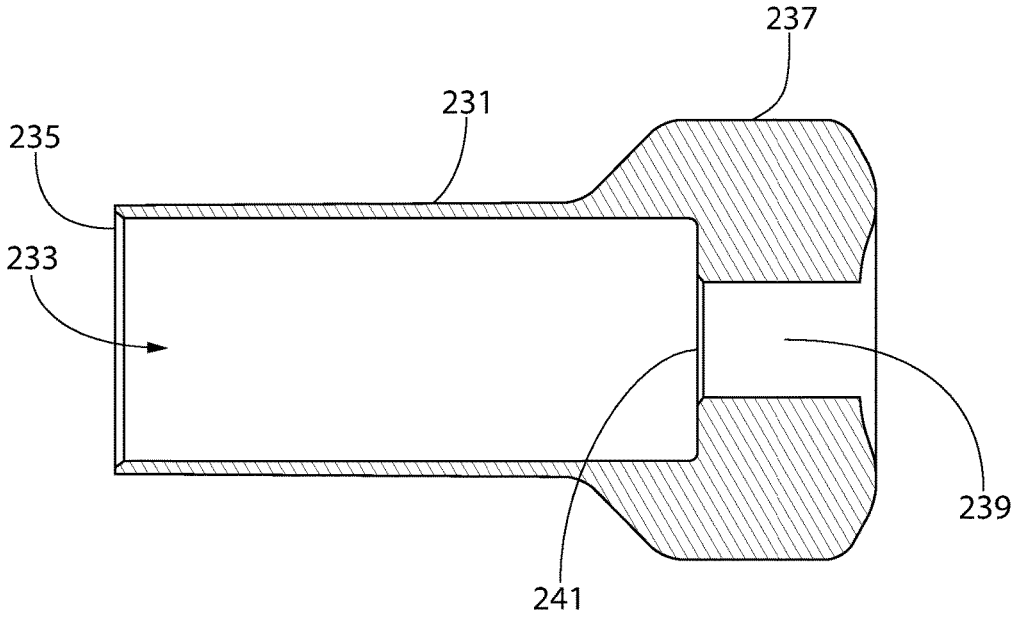
FIG. 16 illustrates a sectional view of the pin knob for the carriage of FIG. 10.
Figure 17:
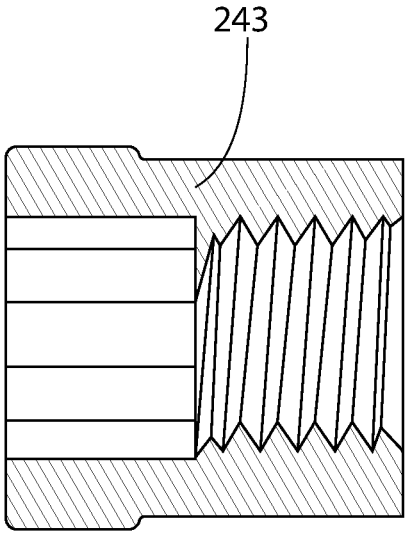
FIG. 17 illustrates a sectional view of the pin nut for the carriage of FIG. 10.
Figure 18:
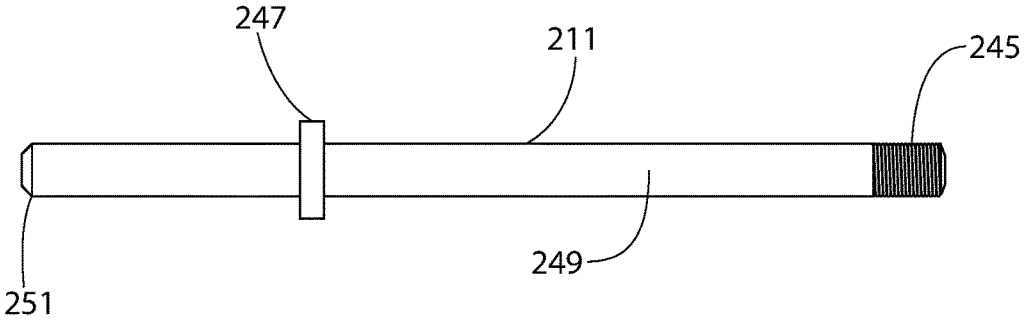
FIG. 18 illustrates a sectional view of the pin rod for the carriage of FIG. 10.
Figure 19:
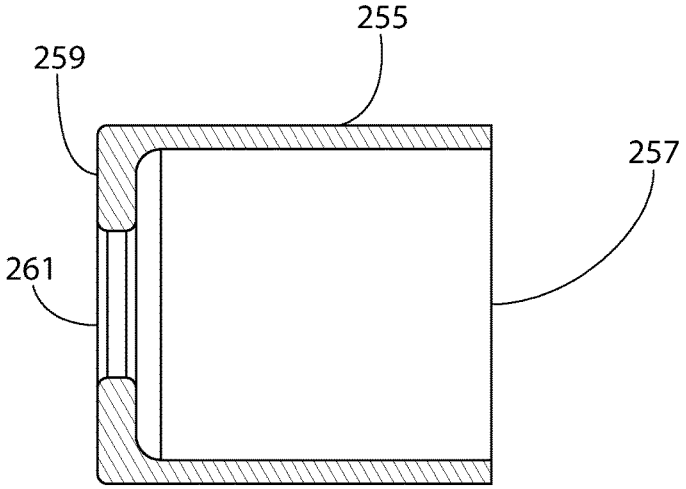
FIG. 19 illustrates a sectional view of the pin stud for the carriage of FIG. 10.

The carriage frame 181 includes two apertures 213, 215 for accommodating the blocking mechanism 183, which includes the pin stud 217 (shown in FIG. 14) affixed over one of the two apertures 213 on the external surface of the carriage frame 181. The pin stud 217 is positioned over the aperture 213 so that when the pin rod 211 extends through the pin stud 217, the pin rod 211 may also partially pass through the sidewall of the carriage frame 181. As shown in FIG. 14, the pin stud 217 includes a non-threaded end 219 which is affixed, and may be welded, to the carriage frame 181 and an external threaded end 221. The end cap 223 shown in FIG. 15 includes an interior threaded end 225 so that the end cap 223 can be coupled to the pin stud 217. The end cap 223 also includes a bearing end 227 which has a hole 229 formed therein so that the pin rod 211 may extend through the end cap 223. The handle 231 shown in FIG. 16 includes a first cavity 233 at one end 235 for being placed over the pin stud 217 and the end cap 223. The knob end 237 of the handle 231 includes a second cavity 239 for receiving a threaded coupler 243, which is shown in FIG. 17. The handle 231 includes a hole 241 between the cavity first 233 and the second cavity 239 so that the pin rod 211 may extend through the hole 241. The pin rod 211, as shown in FIG. 18, includes a threaded end 245 which is threadably coupled to the coupler 243. The pin rod 211 also includes a bearing shoulder 247, with a middle portion 249 positioned between the bearing shoulder 247 and the threaded end 245, and an engagement end 249.

The pin rod 211 is inserted into the center of the spring 253 so that the spring 253 is over the middle portion 249 of the pin rod 211. The spring 253 is set so that one end bears against the bearing shoulder 247 of the pin rod 211 and the other end bears against the end cap 223. As indicated above, the pin rod 211 has the threaded end 245 coupled to the coupler 243 and the pin rod 211 extends through the end cap 233 and through the pin stud 217, so that the fixation end 251 of the pin rod extends into the central opening 189 of the carriage frame 181.

On the inside surface of the carriage frame 181, a first pin guide 255*a* is affixed over one of the apertures 213, and a second pin guide 255*b* is affixed over the other of the apertures 215. The pin guide 255*a*, 255*b* is shown in detail in FIG. 19, as both may be identical parts. In certain embodiments, the two pin guides 255*a*, 255*b* may take on different forms as compared to one another. Both pin guides 255*a*, 255*b* may be welded to the carriage frame 181, or fixed in any other appropriate manner. Each pin guide 255*a*, 255*b* includes an open end 257 which is placed over the respective apertures 213, 215, and each includes a semi-closed end 259, which includes a hole 261 for the pin rod 211 to extend through. The pin guides 255*a*, 255*b* are affixed to the carriage frame 181 in a position so that each extends into the channels 131 on either side of the support track 113. The pin guide 255*a* affixed to the carriage 181 on the same wall as the pin rod 211 serves as a pin stop in that the shoulder 247 of the pin rod 211 is sized to not be able to pass through the hole 261 in the semi-closed end 259 of the pin guide 255*a*. The pin guide 255*b* serves as a receiver for the fixation end 251 if the pin rod 211 after the pin rod 211 has extended through the fixation holes 145 in the support track 113. FIG. 8 shows the carriage frame 181 with the pin rod 211 and the pin guides 255 affixed thereto.

In the assembled blocking mechanism 183, the pin rod is captive between the end cap 223 and the pin guide 255*a*, and the spring is captive between the end cap 223 and the shoulder 247 of the pin rod 211. Configured in this manner, the pin rod 211 is biased toward the pin guide 255*b* and may be pulled by a user to remove the fixation end 2551 of the pin guide from the fixation holes 145 of the support track 113, thereby allowing the carriage to move up and down the support track 113 before being fixed in a different position.

Figure 9:
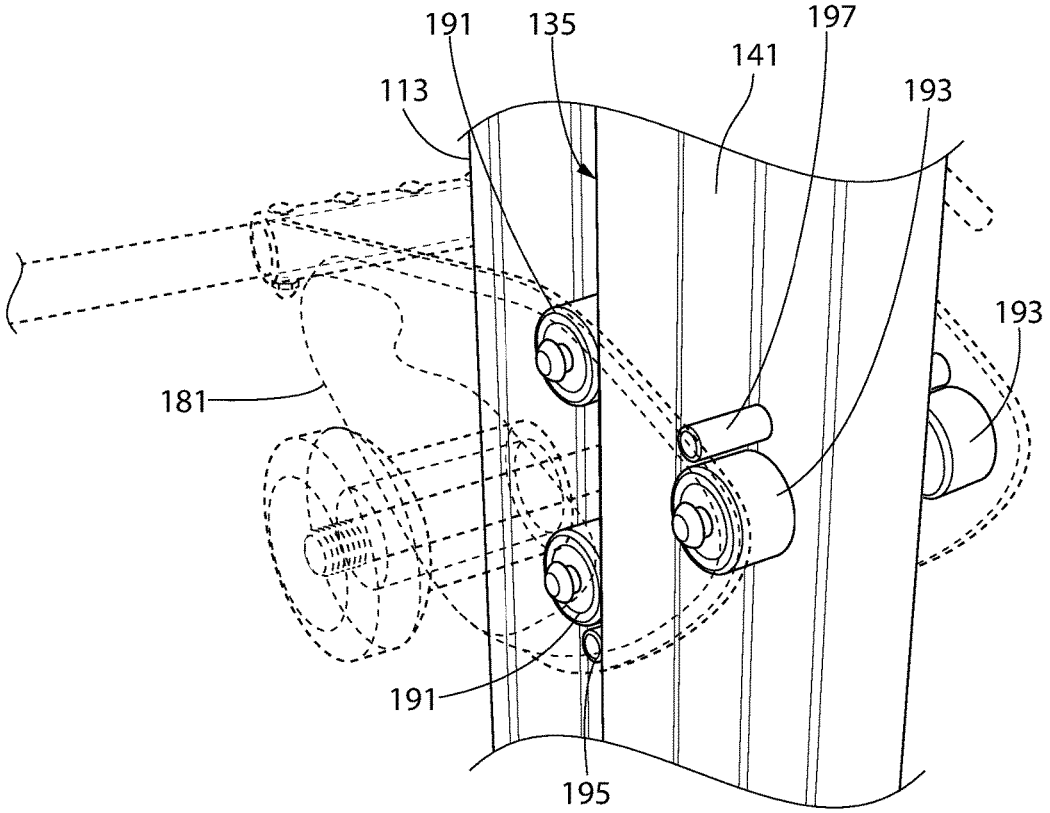
FIG. 9 illustrates a close-up rear perspective view of the carriage coupled to the support track for the exercise apparatus of FIG. 1.
Figure 10:
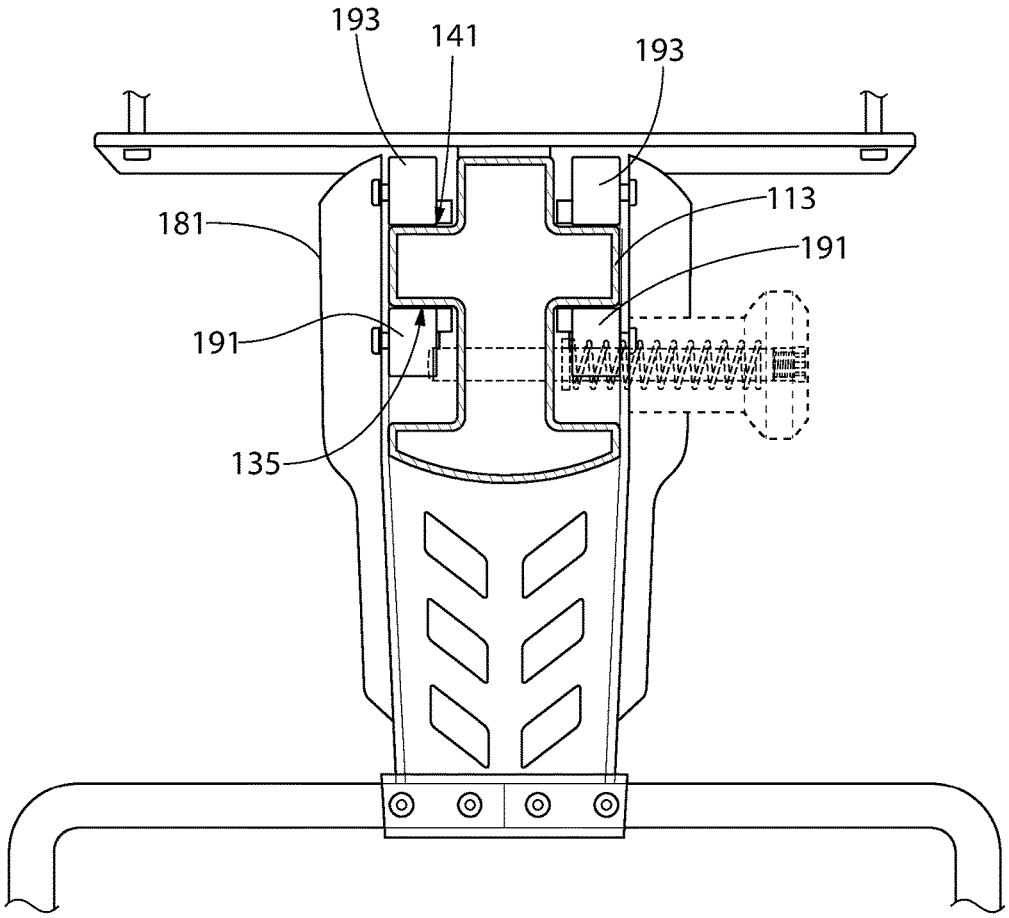
FIG. 10 illustrates a sectional view from above of the carriage coupled to the support track for the exercise apparatus of FIG. 1, with parts of the carriage omitted for clarity.
Figure 11:
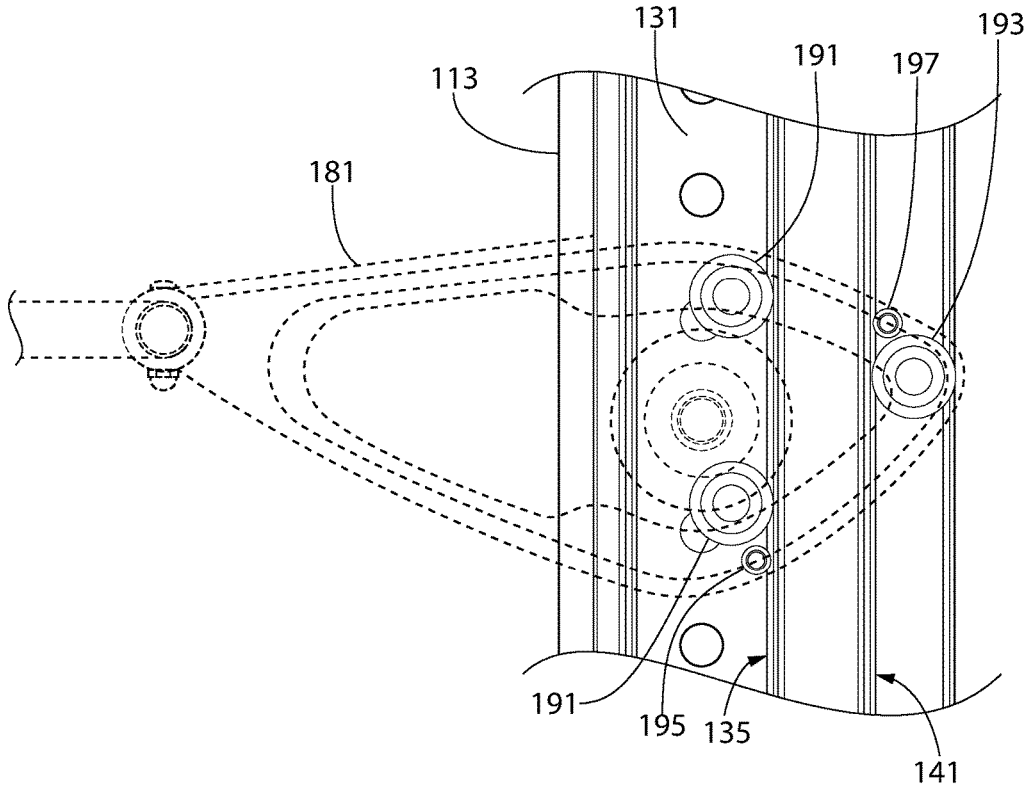
FIG. 11 illustrates a close-up side view of the carriage coupled to the support track for the exercise apparatus of FIG. 1.

FIGS. 9-11 show the carriage 181 in position on the support track 113. As can be seen from these figures collectively, two of the rollers 193 on each side of the carriage 181 are positioned to roll against the channel wall 135, and one roller 195 on each side of the carriage are positioned to roll against the shoulder 141. Similarly, one bearing rod 195 on each side of the carriage 181 is positioned to bear against the channel wall 135, and one bearing rod 197 on each side of the carriage 181 is positioned to bear against the shoulder 141. The blocking mechanism 183 is positioned so that the pin rod 211 may be inserted through selected fixation holes to fix the position of the carriage 181 with respect to the support track 113. Thus, the rollers 191, 193 help the carriage 181 to move to a desired position with respect to the support track 113, the blocking mechanism 183 serves to set and maintain the selected position, and the bearing rods 195, 197 serve to remove the load from the bearings when exercises are performed.

Figure 20A:
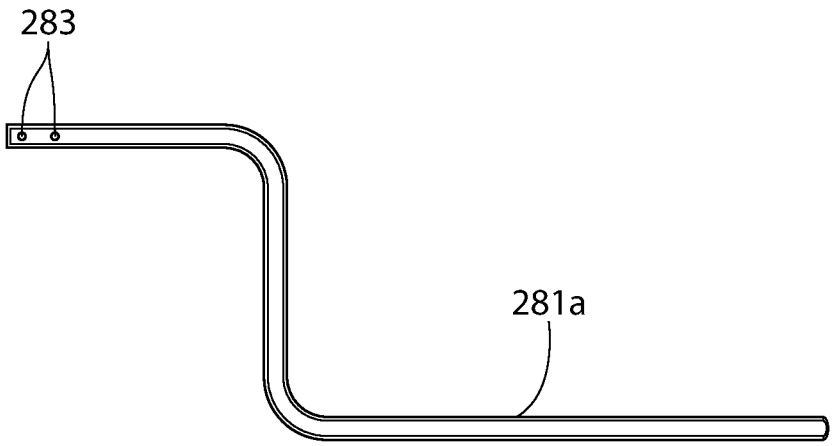
FIGS. 20A-B illustrate a first embodiment of left and right support bars, respectively, for the exercise apparatus of FIG. 1.
Figure 20B:
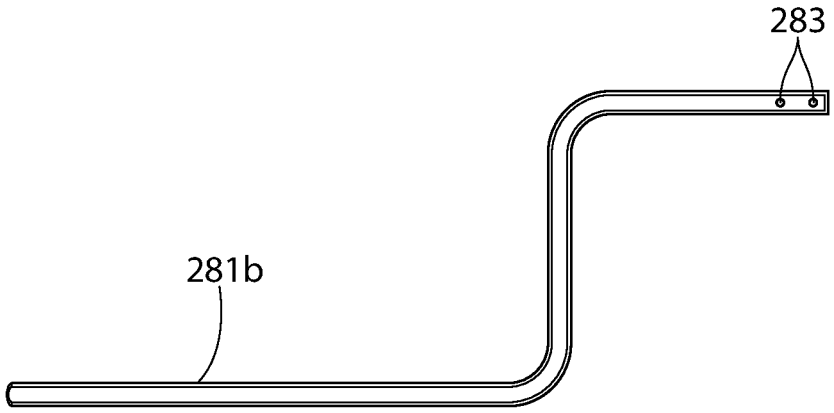
Figure 21A:
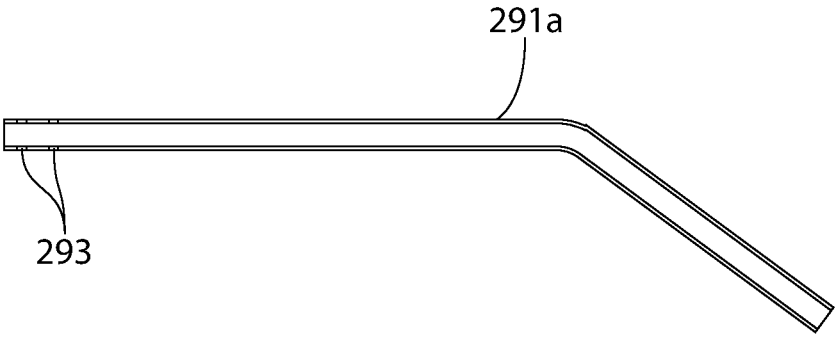
FIGS. 21A-B illustrate a second embodiment of left and right support bars, respectively, for the exercise apparatus of FIG. 1.
Figure 21B:
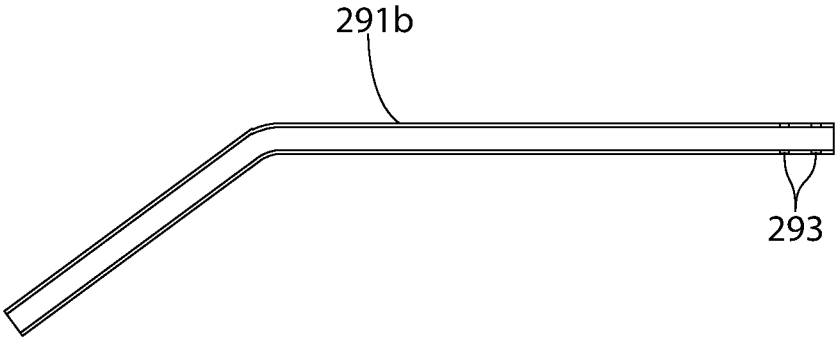

FIGS. 20A-B show right and left support bars 281*a*, 281*b*, respectively. Each support bar 281*a*, 281*b* includes fixation holes 283 for coupling to the bar coupler 201. Thus, when both support bars 281*a*, 281*b* are coupled to the bar coupler 201, the combination of the two support bars 281*a*, 281*b* forms the In certain embodiments, the support bar 117. The support bars 281*a*, 281*b* may be configured in any manner desired, with angles and curves formed as appropriate to serve the function of facilitating exercises. FIGS. 21A-B show another embodiment of right and left support bars 291*a*, 291*b*, Each support bar 291*a*, 291*b* includes fixation holes 293 for coupling to the bar coupler 201.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An exercise apparatus comprising:

a support track having a first side opposite a second side and comprising a first channel extending parallel to a first shoulder on the first side and a second channel extending parallel to a second shoulder on the second side, the first channel and the second channel each including a plurality of fixation holes;

a carriage comprising a carriage frame, a pin rod, and a plurality of first side rollers opposing a plurality of second side rollers, wherein:

the pin rod is coupled to the carriage frame and positioned to be removably inserted into one of the fixation holes in the first channel and into one of the fixation holes in the second channel to fix a position of the carriage with respect to the support track, at least one of the first side rollers is coupled to the carriage frame and positioned within the first channel and another of the first side rollers is coupled to the carriage frame and positioned against the first shoulder, and at least one of the second side rollers is coupled to the carriage frame and positioned within the second channel and another of the second side rollers is coupled to the carriage frame and positioned against the second shoulder; and at least one support bar coupled to the carriage.

2. The exercise apparatus of claim 1, wherein two of the first side rollers are positioned within the first channel, and two of the second side rollers are positioned within the second channel.

3. The exercise apparatus of claim 1, wherein the carriage further comprises at least two first side bearing rods and at least two second side bearing rods affixed to the carriage frame, one of the first side bearing rods positioned within the first side channel and the other of the first side bearing rods positioned adjacent the first shoulder, and one of the second side bearing rods positioned within the second side channel and the other of the second side bearing rods positioned adjacent the second shoulder.

4. The exercise apparatus of claim 3, wherein the one of the first side bearing rods is positioned to bear against a first channel wall of the first side channel, and the other of the first side bearing rods is positioned to bear against the first shoulder, the first channel wall being opposite the first shoulder, and the one of the second bearing rods is positioned to bear against a second channel wall of the second side channel, and the other of the second side bearing rods is positioned to bear against the second shoulder, the second channel wall being opposite the second shoulder.

5. The exercise apparatus of claim 1, wherein the carriage further comprises a bar coupler, the at least one support bar coupled to the bar coupler.

6. The exercise apparatus of claim 1, wherein the at least one support bar comprises a first support bar and a second support bar, with both the first support bar and the second support bar affixed to the bar coupler.

7. The exercise apparatus of claim 1, wherein the pin rod is spring biased toward insertion into the one of the fixation holes in the first channel and into the one of the fixation holes in the second channel.

8. The exercise apparatus of claim 1, further comprising a plurality of wall mount brackets affixed to the support track.

9. The exercise apparatus of claim 1, wherein the carriage further comprises an accessory bar having a first end and a second end, both the first and second ends affixed to the carriage frame.

10. An exercise apparatus comprising:

a support track having a first track side opposite a second track side, each track side comprising a first shoulder opposing a second shoulder and a plurality of fixation holes aligned in a row adjacent and parallel to the first shoulder;

a carriage comprising a carriage frame, a pin rod, and a plurality of first side rollers opposing a plurality of second side rollers, wherein:

the pin rod is coupled to the carriage frame and positioned to be removably inserted into one of the fixation holes on the first track side and into one of the fixation holes on the second track side to fix a position of the carriage with respect to the support track, at least one of the first side rollers is coupled to the carriage frame and positioned to roll against the first shoulder of the first track side and another of the first side rollers is coupled to the carriage frame and positioned to roll against the second shoulder of the first track side, and at least one of the second side rollers is coupled to the carriage frame and positioned to roll against the first shoulder of the second track side and another of the second side rollers is coupled to the carriage frame and positioned to roll against the second shoulder of the second track side; and at least one support bar coupled to the carriage.

11. The exercise apparatus of claim 10, wherein two of the first side rollers are positioned to roll against the first shoulder of the first track side, and two of the second side rollers are positioned to roll against the first shoulder of the second track side.

12. The exercise apparatus of claim 10, wherein the carriage further comprises at least two first side bearing rods and at least two second side bearing rods affixed to the carriage frame, one of the first side bearing rods positioned to bear against the first shoulder of the first track side and the other of the first side bearing rods positioned to bear against the second shoulder of the first track side, and one of the second side bearing rods positioned to bear against the first shoulder of the second track side and the other of the second side bearing rods positioned to bear against the second shoulder of the second track side.

13. The exercise apparatus of claim 10, wherein the carriage further comprising a bar coupler coupled to the carriage frame, the at least one support bar coupled to the bar coupler.

14. The exercise apparatus of claim 10, wherein the at least one support bar comprises a first support bar and a second support bar, both the first support bar and the second support bar affixed to the bar coupler.

15. The exercise apparatus of claim 10, wherein the pin rod is spring biased toward insertion into the one of the fixation holes on the first track side and into the one of the fixation holes on the second track side.

16. The exercise apparatus of claim 10, further comprising a plurality of wall mount brackets affixed to the support track.

17. The exercise apparatus of claim 10, wherein the carriage further comprises an accessory bar having a first end and a second end, both the first and second ends affixed to the carriage frame.

18. An exercise apparatus comprising:

a support track having a first side opposite a second side and comprising a first channel on the first side, a second channel on the second side, and a row of fixation holes, the first channel, the second channel, and the row of fixation holes being parallel to each other;

a carriage comprising a carriage frame, a pin rod, at least one first side roller, at least one second side roller, at least one first bearing rod, and at least one second bearing rod, wherein:

the pin rod is coupled to the carriage frame and positioned to be removably inserted into at least one of the fixation holes to fix a position of the carriage with respect to the support track, at least one of the first side rollers is coupled to the carriage frame and positioned within the first channel, at least one of the second side rollers is coupled to the carriage frame and positioned within the second channel, the at least one first bearing rod is affixed to the carriage frame and positioned within the first channel to bear against a first channel wall of the first channel, and the at least one second bearing rod is affixed to the carriage frame and positioned within the second channel to bear against a second channel wall of the second channel; and at least one support bar affixed to the carriage.

19. The exercise apparatus of claim 18, wherein the pin rod is spring biased toward insertion into the one of the fixation holes in the first channel and into the one of the fixation holes in the second channel.

20. The exercise apparatus of claim 18, further comprising a plurality of wall mount brackets affixed to the support track.

* * * * *